United States Patent [19]

Bornand

[11] 4,132,102

[45] Jan. 2, 1979

[54] MACHINE TO WORK SHEET MATERIAL

[76] Inventor: René Bornand, 34, chemin de Beaulieu, Bienne, Berne, Switzerland, CH-2500

[21] Appl. No.: 823,091

[22] Filed: Aug. 9, 1977

[30] Foreign Application Priority Data

Aug. 16, 1976 [CH] Switzerland ..... 10379/76

[51] Int. Cl.[2] ..... B21D 37/00

[52] U.S. Cl. ..... 72/324; 72/384; 72/464

[58] Field of Search ..... 72/384, 442, 464, 324; 83/518, 515, 514, 513

[56] References Cited

U.S. PATENT DOCUMENTS

| | | | |
|---|---|---|---|
| 42,004 | 3/1864 | Lamplugh | 72/384 |
| 234,037 | 11/1880 | Jentzsch | 72/384 |
| 704,344 | 7/1902 | Kidder | 83/518 |
| 855,765 | 6/1907 | Gerlach | 83/518 |

*Primary Examiner*—Lowell A. Larson
*Attorney, Agent, or Firm*—Emory L. Groff, Jr.

[57] ABSTRACT

A machine to work sheet material such as aluminium sheets or cardboard. Said machine comprises altogether a folding tool, a cutting tool, a punching tool and a single gearing down lever actuating these three tools simultaneously.

1 Claim, 3 Drawing Figures

MACHINE TO WORK SHEET MATERIAL

The invention relates to a machine to work sheet material such as aluminium sheet or cardboard.

For this type of work and, in particular for the fabrication of strips, angle pieces or metallic plates shears, folding pliers and punching dies are commonly used.

The machine according to the invention is characterized in that it comprises at least two tools chosen amongst folding, cutting and punching tools.

Thus, at least two operations, for example cutting and folding, may be accomplished on the same machine, which speeds up the work.

The accompanying drawing shows diagrammatically and by way of example an embodiment of a machine according to the invention.

Figure 1:
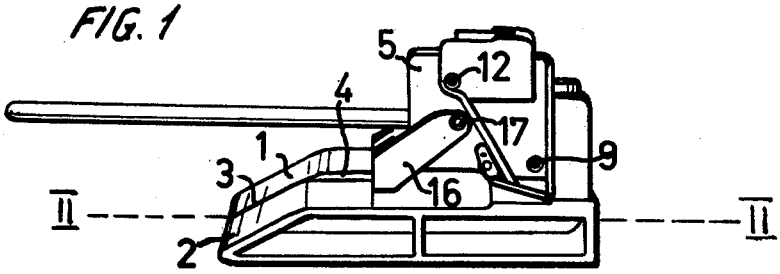
FIG. 1 is a side view thereof in perspective with the actuating lever in its lowermost position.
Figure 2:
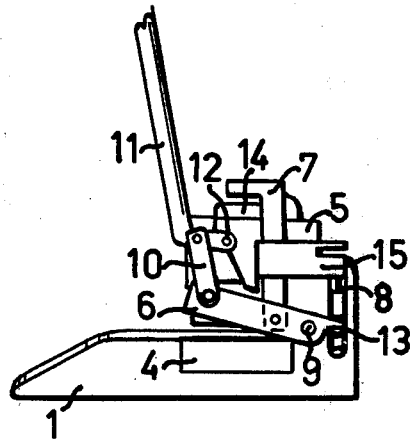
FIG. 2 is a longitudinal section thereof along the line II—II of FIG. 1, the actuating lever being raised.
Figure 3:
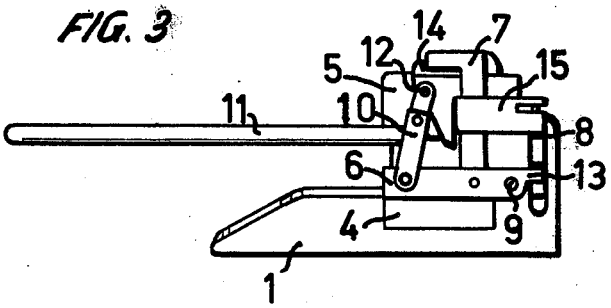
FIG. 3 is a view similar to FIG. 2 once the actuating lever is lowered.

The machine shown on the drawing comprises a base in two parts 1 and 2 separated by a longitudinal median slot 3, in which a lower knife 4 is fastened.

Parts 1 and 2 of the base are provided with upwards extending vertical side-pieces 5 providing between themselves recesses within which an upper knife 6, a folding angle-iron 7 and a punching tool 8 are guided.

The upper knife 6 is pivoted at one of its ends to the frame of the machine, between the side-pieces 5, on a screw 9. Its other end is linked by means of a connecting rod 10 to a lever 11 close to one of its ends which is pivoted between the side-pieces 5 of the frame on a screw 12.

An end of the folding angle-iron 7 is linked to the upper knife 6 between its end pivoted to the sidepieces 5, and its end pivoted to the connecting rod 10. The end of the upper knife pivoted to the side-pieces 5, of the frame of the machine is provided with an extension 13 actuating the punching tool 8.

Thus, when the lever 11 is lowered, the upper knife 6 pivots around screw 9 and cooperates with the lower knife 4 to produce a shearing effect. It is thus possible to cut a sheet engaged between these two knives 4, 6 on base 1, 2.

The upper edge of the side-pieces 5 includes an area 14 having a V shaped cross-section and located underneath the horizontal arm of the angle-iron 7. When lever 11 is lowered, the angle-iron 7 is pulled downwards by the upper knife 6 to which it is linked. It is thus possible to fold a sheet positioned in the area 14 of the upper edge of side-pieces 5 towards which the horizontal arm of angle-iron 7 is lowered.

The back edge of the frame of the machine is provided at its upper end with a guiding piece 15 for the punching tool 8, which is slotted parallel to base 1, 2. This slotted piece 15 is provided a vertical bore whithin which the punch 8 penetrates upwards when the actuating lever 11 is lowered. It is thus possible to punch a sheet engaged in the slot of piece 15.

A U shaped guard-piece 16, made of transparent synthetic resin is further pivoted at the free end of the arms of the U on a screw 17 provided crosswise through the vertical side-pieces 5 of the frame, the base of the U being resting on the upper face of the base 1, 2. This guard-piece 16 prevents any accidental engagement of the operator's fingers between knives 4 and 6 during a folding or punching operation.

Numerous variations of the machine described and shown in the drawing can be contemplated.

According to one of these variations, the machine contains only two tools, for example a folding tool and cutting tool operated by the same lever 11. In another variation, the machine could be provided with two tools, each operated by different levers. The lever or levers may also be replaced by a screwing device.

I claim:

1. A machine including a frame for working sheet material comprising a base including two parallel parts having a slot therebetween, a side piece extending upwardly from each base part, said side pieces providing a space between them, a lower knife secured to one of said base parts and disposed within said slot, an upper knife pivoted at one end to said side pieces, a lever pivoted at one end to said frame and pivotally connected at its other end to one end of said upper knife, said lever extending angularly upwardly from said base when in its inoperative position, a folding tool guided on said frame for vertical movement and pivoted at its lower end to said upper knife between the opposite ends thereof, a guide member mounted on said frame and having a slot parallel to said base and a vertical bore beneath said slot, a punching tool slidable in said bore, said upper knife having an extension at its end pivoted to the side pieces, said extension engaging said punching tool whereby when said lever is moved downwardly said upper and lower knives are moved together to produce a shearing effect on a sheet of material between said knives said folding tool is pulled downwardly by said upper knife to exert a folding effect on a sheet of material in its downward path and said punching tool is moved upwardly by said extension on the upper knife to punch a hole in a sheet of material in the path of its upward movement.

* * * * *